US006661214B1

(12) United States Patent
Hann et al.

(10) Patent No.: US 6,661,214 B1
(45) Date of Patent: Dec. 9, 2003

(54) DROOP COMPENSATION CIRCUITRY

(75) Inventors: Raymond Eugene Hann, San Bernardino, CA (US); James John Polston, Palmdale, CA (US); Makoto Andrew Igawa, Granada Hills, CA (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 0 days.

(21) Appl. No.: 09/964,741

(22) Filed: Sep. 28, 2001

(51) Int. Cl.[7] ..... G05F 1/40
(52) U.S. Cl. ..... 323/280
(58) Field of Search ..... 323/265, 273, 323/280, 284, 351

(56) References Cited

U.S. PATENT DOCUMENTS

| | | | | |
|---|---|---|---|---|
| 4,035,716 | A | | 7/1977 | Hutchinson |
| 4,041,431 | A | | 8/1977 | Enoksen |
| 4,237,555 | A | * | 12/1980 | Dishal ..... 455/108 |
| 4,533,863 | A | | 8/1985 | Luhn et al. |
| 4,630,220 | A | | 12/1986 | Peckinpaugh |
| 4,667,144 | A | * | 5/1987 | Jones et al. ..... 323/271 |
| 4,761,702 | A | | 8/1988 | Pinard |
| 4,893,228 | A | | 1/1990 | Orrick et al. |
| 5,070,538 | A | | 12/1991 | Milberger et al. |
| 5,117,174 | A | | 5/1992 | Kessler |
| 5,170,493 | A | | 12/1992 | Roth |
| 5,187,427 | A | | 2/1993 | Erdman |
| 5,264,782 | A | | 11/1993 | Newton |
| 5,298,851 | A | | 3/1994 | DeNardis |
| 5,336,986 | A | | 8/1994 | Allman |
| 5,359,276 | A | | 10/1994 | Mammano |
| 5,672,959 | A | | 9/1997 | Der |
| 5,905,646 | A | * | 5/1999 | Crewson et al. ..... 363/132 |
| 5,938,769 | A | | 8/1999 | Hu |
| 5,940,785 | A | | 8/1999 | Georgiou et al. |
| 5,943,224 | A | | 8/1999 | Mao |
| 5,959,852 | A | | 9/1999 | Deloty et al. |
| 6,031,421 | A | | 2/2000 | McEwan |
| 6,037,759 | A | | 3/2000 | Chen et al. |
| 6,057,607 | A | * | 5/2000 | Rader et al. ..... 307/11 |
| 6,114,817 | A | | 9/2000 | Fernsler |
| 6,130,575 | A | | 10/2000 | Nelson et al. |
| 6,160,591 | A | | 12/2000 | Stumfall et al. |
| 6,181,116 | B1 | | 1/2001 | Jansen |
| 6,188,206 | B1 | | 2/2001 | Nguyen et al. |
| 6,211,661 | B1 | | 4/2001 | Eckhardt |
| 6,232,893 | B1 | | 5/2001 | Cliff et al. |
| 6,246,221 | B1 | | 6/2001 | Xi |
| 6,304,131 | B1 | | 10/2001 | Huggins et al. |

* cited by examiner

*Primary Examiner*—Adolf D. Berhane
(74) *Attorney, Agent, or Firm*—Hunton & Williams LLP

(57) ABSTRACT

An embodiment of the present invention comprises a voltage regulator including a droop compensation circuit and a voltage regulator circuit. The droop compensation circuit compensates for an output that changes over a period of time. This variable output may be the result of voltage regulator droop and/or a load transistor droop. For instance, the voltage regulator droop may be associated with the decrease in regulator output voltage that occurs during the course of applying a load. The load transistor droop may correspond to the decrease in RF transistor gain that occurs over the course of a transmit pulse. The variable output could be attributable to other phenomena. Moreover, the variable output that is compensated for is not necessarily decreasing over time, but, in fact, could be increasing over time, or could exhibit increases and decreases over time.

73 Claims, 12 Drawing Sheets

PRIOR ART

PRIOR ART

PRIOR ART

DROOP COMPENSATION CIRCUITRY

GOVERNMENT RIGHTS

Because the invention was made under contract N00024-98-C-5200 (Department of the Navy), the Government may have certain rights in the invention.

FIELD OF THE INVENTION

The present invention relates generally to a regulator used to regulate the input voltage to transistor-based loads, such as to RF preamplifiers or RF amplifiers employed to drive solid state pulsed radar transmitters.

BACKGROUND OF THE INVENTION

Voltage regulators are used in a variety of contexts for providing and regulating the voltage applied to electronic circuit devices. Just by way of example, voltage regulators are an important system component in solid-state pulsed radar systems. In that context, voltage regulators are used to regulate the voltage supplied to various loads such as preamplifiers or amplifiers that power the radar transmitter circuitry.

One common problem with linear voltage regulators is that their voltage output will tend to decrease during loading (e.g., during transmit gate pulses) until the regulator senses the error and begins to regulate the output voltage. This decrease is sometimes referred to as "droop." Generally, this problem is attributable to the voltage regulator output capacitance droop ($dV=1/C*Idt$). In the context of a pulsed radar system, this droop in the output voltage causes a decrease in the RF transistor power output. This results in suboptimal system performance.

This problem of a decrease in the RF transistor output may worsen in systems having multiple cascaded stages, such as in a solid-state radar system with cascaded amplifiers. Accordingly, the performance loss accumulates.

Additionally, it is common that RF transistor-based circuits will tend to exhibit their own natural droop over the course of a powering cycle. For example, high (e.g., microwave) frequency RF transistor-based circuitry in a pulsed radar system will tend to exhibit a droop in gain that worsens over the course of the transmit pulse. This may be attributable to heating of the RF transistor junction during an RF pulse, which, in turn, may cause a decrease in the transistor output power during the RF transmit pulse. The RF output power is no longer constant throughout the RF pulse, resulting in suboptimal performance.

When a voltage regulator exhibiting its own droop is used with a transistor-based circuit having its own internal droop, the overall performance loss exacerbates. That is, the droop in the regulator output voltage causes a decrease in the RF transistor power output, thereby adding to an already decreasing output power that is caused by the characteristics of the RF transistor.

Conventional voltage regulators, such as linear regulators in the prior art, may suffer the aforementioned drawbacks. In a linear regulator, the voltage is typically preset to a predetermined voltage ("reference voltage") for normal operation. In some cases this reference voltage is adjustable so that a more accurate output voltage can be established when the load is applied. Otherwise, in a typical linear voltage regulator, the reference voltage does not change once it is set. Accordingly, the linear regulator output voltage may decrease during load pulses due to the droop in the output capacitor voltage.

FIG. 1 illustrates a conventional linear regulator circuit. Typical linear regulators may be "off-line" or "on-line." An off-line linear regulator will tend to have a smaller input capacitance and a larger output capacitance. An on-line regulator tends to have larger input capacitance and a smaller output capacitance. Both types will tend to exhibit the problems discussed above.

FIG. 2 is an illustration (not to scale) of an example of the problem of internal transistor droop. In FIG. 2, graph A represents an ideal regulator output voltage, where the regulator output voltage is constant and is without droop. Graph B represents the output of a transistor-based circuit that is regulated by the ideal regulator output voltage. As can be seen, over the course of a gate pulse the transistor-based circuit exhibits an increasing transistor droop 200. Once again, this may be attributable to heating of the RF transistor junction during an RF pulse, which, in turn, may cause a decrease in the transistor output power during the RF transmit pulse. The RF output power is no longer constant throughout the RF pulse, resulting in suboptimal performance.

FIG. 3 is an illustration (not to scale) of an example of the problem of regulator droop in conjunction with load transistor droop. In FIG. 3, graph A represents a regulator output voltage (e.g., a linear regulator with an output capacitance) that exhibits a regulator droop 300 over the course of a gate pulse. This regulator droop 300 aggregates or combines with the load transistor's internal droop to render an even greater overall amplifier output droop 350. This represents that a further degraded system-level performance when compared to FIG. 2. Not only is the power output of FIG. 3 not constant over time (like FIG. 2), but the average power output of FIG. 3 is even less than that of FIG. 2. This is a significant drawback.

In sum, so-called "real world" voltage regulators used with real world transistor-based circuits tend to suffer significant performance losses associated with regulator droop and/or load transistor droop. In high stability systems, like solid state pulsed radar systems, these performance losses can be a significant problem. This problem can be mitigated somewhat by using custom transistors (or by screening commercial-off-the-shelf [COTS] transistors), but this may greatly increase the costs of production. In many markets, such as for low- to medium-production military applications, these cost increases may not be acceptable.

Finally, it can be readily appreciated that the problem of voltage droop exists in other contexts. For example, instead of an RF transistor load for the regulator, there may be some other component, device, or system, whose output response (e.g., voltage, gain, power, etc.) exhibits some undesirable variation over time. Also, the variation of this output response or gain may increase over some time period, decrease over some time period, or increase and decrease at points over a time period. The common problem is that of how to control (or compensate for) the time variable output response in order to render the desired output response. Generally, the desired output response is constant or flat over some period of time for the system at issue. Sometimes, a non-flat response may be desired.

Other problems and drawbacks also exist.

SUMMARY OF THE INVENTION

An embodiment of the present invention comprises a voltage regulator including a droop compensation circuit and a voltage regulator circuit. The droop compensation circuit compensates for an output that changes over a period of time. This variable output may be the result of voltage regulator droop and/or a load transistor droop. For instance, the voltage regulator droop may be associated with the decrease in regulator output voltage that occurs during the course of applying a load. The load transistor droop may correspond to the decrease in RF transistor gain that occurs over the course of a transmit pulse. The variable output could be attributable to other phenomena. Moreover, the variable output that is compensated for is not necessarily decreasing over time, but, in fact, could be increasing over time, or could exhibit increases and decreases over time.

The voltage regulator of the present invention may be used to regulate the voltage supplied to a preamplifier circuit or an amplifier circuit. The droop compensation circuit may include a control circuit, an offset circuit, and a discharge circuit. The droop compensation circuit may be designed to render a desired output response of the preamplifier circuit or the amplifier circuit. According to one aspect of the invention, the desired output response is substantially flat over the course of a transmit cycle. According to another aspect of the invention, the desired output response is not flat over the course of a transmit cycle. The transmit cycle may correspond to the transmit cycle of a pulsed radar system. The voltage regulator may be an on-line linear regulator.

According to another aspect of the invention, a droop compensation circuit is disclosed. The droop compensation circuit may include means for controlling a variable voltage to be input as a reference voltage. The droop compensation circuit may also include means for generating the variable voltage. The variable voltage can be input to a voltage regulator as the reference voltage.

According to another aspect of the invention, a method for regulating voltage supplied to a preamplifier circuit or an amplifier circuit is disclosed. A regulator voltage output is supplied to the preamplifier circuit or the amplifier circuit. A variable output is counteracted by compensating for a voltage regulator droop and/or a load transistor droop. The compensation may begin before the regulator voltage output is supplied to the preamplifier circuit or the amplifier circuit in order to quicken recovery and/or to reduce oscillations or instability. The method may also include the step of discharging the regulator voltage output in order to quicken recovery.

Accordingly, it is one object of the present invention to overcome one or more of the aforementioned and other limitations of existing systems and methods for regulating voltage supplied to an electronic circuit, such as a transistor-based preamplifier circuit or amplifier circuit.

It is another object of the invention to provide a voltage regulator that solves or mitigates the problem of droop in electronic circuits.

It is another object of the invention to provide a voltage regulator that solves or mitigates the problem of droop so that COTS RF transistors can be used in the regulator load without special screening procedures.

It is another object of the invention to provide a voltage regulator for use in high stability radar systems so that the system response during a transmit cycle remains substantially constant.

The accompanying drawings are included to provide a further understanding of the invention and are incorporated in and constitute part of this specification, illustrate several embodiments of the invention and, together with the description, serve to explain the principles of the invention. It will become apparent from the drawings and detailed description that other objects, advantages and benefits of the invention also exist.

Additional features and advantages of the invention will be set forth in the description that follows, and in part will be apparent from the description, or may be learned by practice of the invention. The objectives and other advantages of the invention will be realized and attained by the system and methods, particularly pointed out in the written description and claims hereof as well as the appended drawings.

BRIEF DESCRIPTION OF THE DRAWINGS

The purpose and advantages of the present invention will be apparent to those of skill in the art from the following detailed description in conjunction with the appended drawings in which like reference characters are used to indicate like elements, and in which.

DETAILED DESCRIPTION OF THE INVENTION

Figure 1:
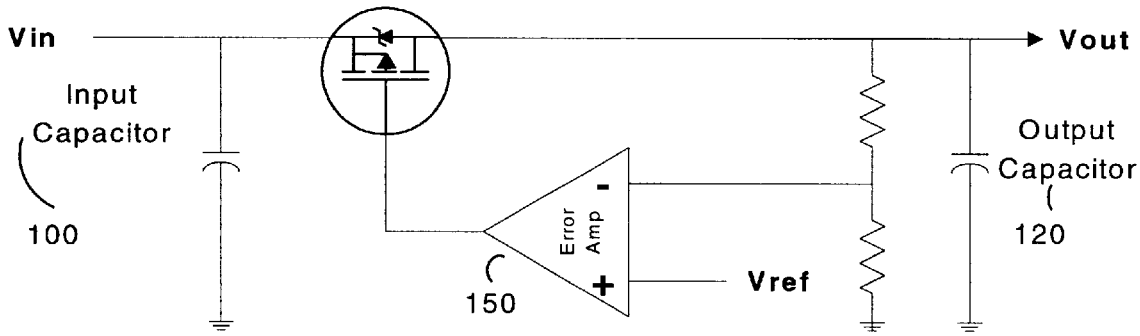
FIG. 1 is an electrical schematic of a conventional voltage regulator.
Figure 2:
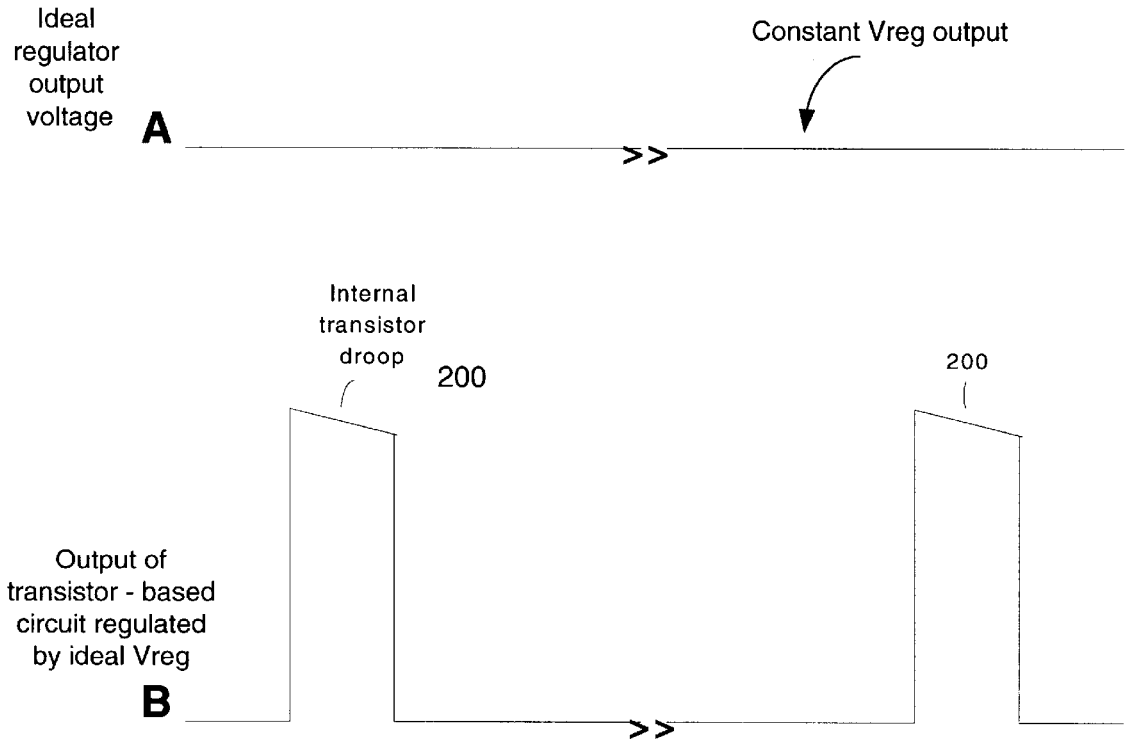
FIG. 2 is an exemplary graph illustrating the problem of transistor droop presented by prior art approaches to voltage regulation of transistor-based circuits.
Figure 3:
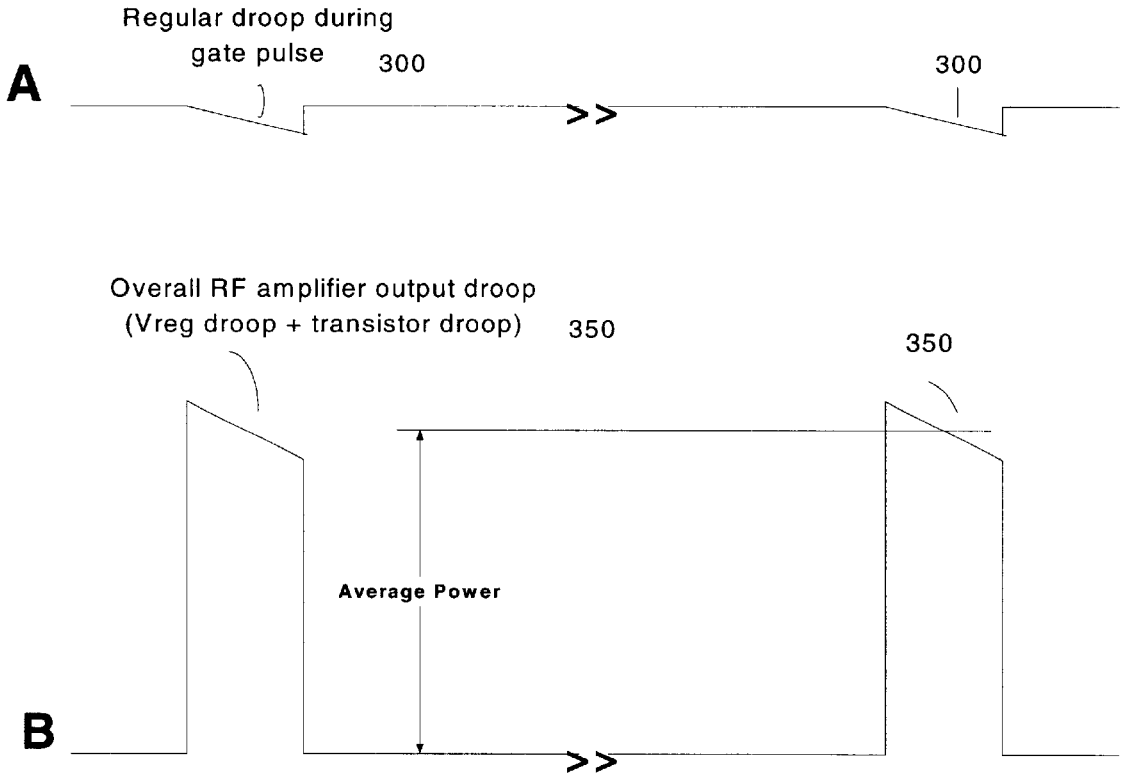
FIG. 3 is a exemplary graph illustrating the problems of voltage regulator droop and transistor droop presented by prior art approaches to voltage regulation of transistor-based circuits.
Figure 4:
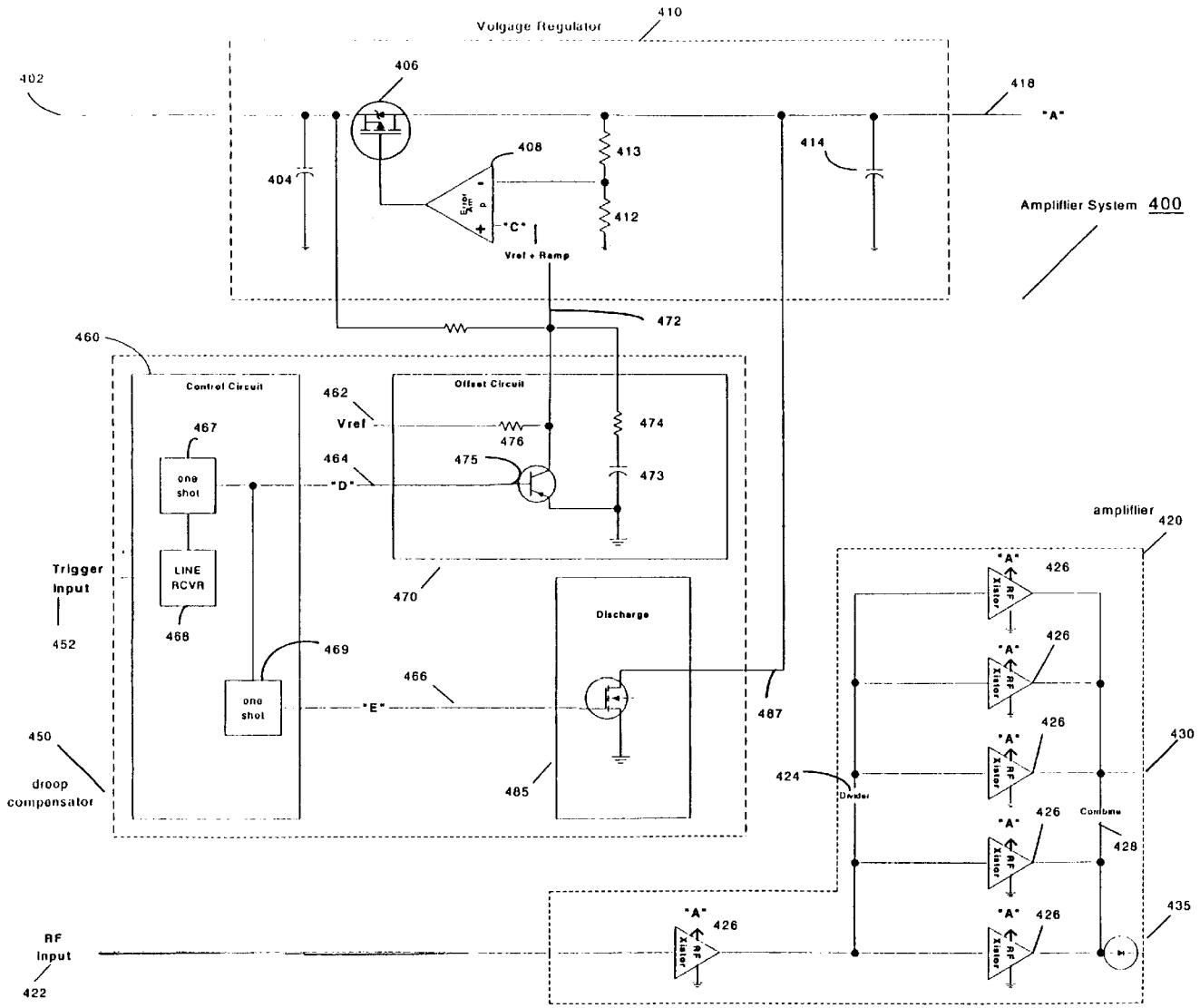
FIG. 4 is an exemplary amplifier system according to an embodiment of the invention.

FIG. 4 is an exemplary amplifier system according to an embodiment of the invention for addressing the problem of voltage droop. Exemplary amplifier system 400 may be a preamplifier system, amplifier system, or a combination of the two. Amplifier system 400 includes voltage regulator 410, amplifier 420, and droop compensator 450.

According to an embodiment, the operation of amplifier system 400 is as follows. Droop compensator 450 provides a voltage to an input of voltage regulator 410. Preferably, this voltage is an adjusted voltage comprising a nominal reference voltage adjusted by an offset voltage. The offset voltage can be a positive offset, a negative offset, or a zero offset. Preferably, when droop compensator 450 is enabled during a transmit cycle, the offset voltage will be a positive offset so that the adjusted voltage supplied to voltage regulator 410 will be adjusted upwards. This upward adjustment can compensate for a droop in either the regulator output voltage, the RF transistor output, or both.

The droop may be associated with the voltage regulator 410, with the amplifier 420, with both the voltage regulator 410 and the amplifier 420, or with another system component. The droop may be an expected or an anticipated droop that is based on empirical measurements or theoretical calculations. The values for the expected droop (or for the adjusted voltage used to compensate for the expected droop) may be selected or computed by droop compensator 450. For example, values for the expected droop (or for the adjusted voltage used to compensate for the expected droop) could be selected (e.g., selected from a memory) by droop compensator 450, which are then used to cause the addition of an appropriate offset voltage. In another example, the values for the expected droop (or for the adjusted voltage used to compensate for the expected droop) could be computed by droop compensator 450 based on an equation.

According to another embodiment, the values for the droop (or for the adjusted voltage used to compensate for the droop) could be based on a measured or projected droop based on a feedback measurement. For example, the droop of voltage regulator 410 could be measured or projected based on a feedback (not shown) from regulator output voltage 418. Similarly, the droop of amplifier 420 could be measured or projected based on a feedback (not shown) from RF output 430 or detected RF output 435. Accordingly, such a feedback could be used by droop compensator 450 to determine how much droop compensation (e.g., voltage offset) is appropriate for the circumstance.

Once the offset voltage is computed or determined, droop compensator 450 provides the adjusted voltage to the input of voltage regulator 410. This adjusted voltage (which can be referred to as $V_{REFERENCE}'$) controls the output voltage 418 of voltage regulator 410. Output voltage 418 of regulator 410 is provided as an input to amplifier 420. Preferably, output voltage 418 is provided as an input to one or more transistors (or like semiconductor devices) in amplifier 420. For example, output voltage 418 may be provided as an input voltage to the RF transistor circuits (e.g., amplifier 420). There may also be a RF input 422 to amplifier 420. Generally, the characteristics of RF input 422 depend on the system specification for a particular application, as does the operational frequency of the RF transistor circuits (e.g., amplifier 420).

Because the adjusted voltage compensates for droop, the output response of the system component at issue can be adjusted to provide a desired output response. For example, the desired output response may be a flat or a non-flat response. Preferably, the desired output response is a flat response.

According to one embodiment, the desired output response is a flat response for the output voltage 418 of regulator 410. According to another embodiment, the desired output response is a flat response for the RF output 430 or the detected RF output 435 of amplifier 420. According to yet another embodiment, the desired output response is a non-flat response for amplifier 420, such as an output response that ramps up or increases during the course of a transmit cycle. Those of skill in the art will readily appreciate that many different variations of the desired output response can be accommodated without departing from the spirit and scope of the present invention.

According to an embodiment, droop compensator 450 comprises a control circuit 460 and an offset circuit 470. Control circuit 460 controls a variable voltage to be input to voltage regulator 410, i.e., an adjusted voltage. Offset circuit 470 generates the variable voltage. For example, offset circuit 470 may generate an offset voltage to be combined with a reference voltage. Offset circuit 470 may also generate the nominal reference voltage, or the nominal reference voltage may be received as an input to offset circuit 470.

According to a preferred embodiment, droop compensator 450 further includes a discharge circuit 485. Discharge circuit 485 permits discharging of output voltage 418 of voltage regulator 410. This can be employed to accelerate the return of output voltage 418 to a nominal value, such as to the nominal reference voltage. Accordingly, inclusion of such a discharge circuit 485 can improve the so-called "recovery time" of voltage regulator 410 following the end of a transmit cycle.

According to an embodiment, control circuit 460 has an input trigger 452 for activating/deactivating droop compensator 450. Control circuit 460 also has a transmit gate 464 output that is coupled to offset circuit 470. Transmit gate 464 may comprise a transmit gate that activates/deactivates droop compensation. Control circuit 460 may also include a discharge trigger 466 that is used to activate/deactivate the discharge circuit 485.

Control circuit 460 can be implemented in a multitude of fashions, and the design of control circuit 460 for a particular application is well within the skill of the ordinary artisan. For example, control circuit 460 may include circuitry for controlling the sequencing of offset circuit 470 and discharge circuit 485. Control circuit 460 may include input components (e.g., line receivers), timing generators (e.g., one shot devices, D/A signal converters, and so forth), and sensing circuits (e.g., resistive divider, current sensors, and so forth).

According to one embodiment, control circuit 460 includes one shot device 467, line receiver 468, and one shot device 469. After receiving trigger input 452, line receiver 468 enables one shot device 467 to activate/deactivate droop compensation. Line receiver 468 may also enable one shot 469 to activate/deactivate discharge circuit 485.

According to an embodiment, offset circuit 470 has a nominal reference voltage input 462, a transmit gate 464 that is input from control circuit 460, and an adjusted output voltage 472 that is provided to voltage regulator 410.

A variety of implementations of offset circuit 470 could be used, and the design of offset circuit 470 for a particular application is well within the skill of the ordinary artisan. For example, offset circuit 470 may include input signal circuits (e.g., line receivers, differential inputs, and so forth), ramp generators (e.g., RC networks, adders, and so forth), and discharge circuits for ramp generators (e.g., active type energy dump circuits and so forth).

According to one embodiment, offset circuit 470 comprises a waveform (ramp) generation circuit. According to a preferred embodiment, offset circuit 470 includes a D-A converter to generate a waveform according to a desired output wave shape. This wave shape may be linear or nonlinear. In one configuration, offset circuit 470 includes a ramp generator comprised of capacitor 473 and resistance 474, an active type ramp discharge 475, and input resistance 476. This configuration is provided merely as an example of many implementations that could be employed for offset circuit 470 without departing from the spirit and scope of the invention.

According to an embodiment, discharge circuit 485 includes a discharge trigger 466 input from control circuit 460. Preferably, discharge circuit 485 also includes a connection 487 to output voltage 418 so that energy can be dissipated when output voltage 418 is to be reduced.

Discharge circuit 485 can be implemented in a various fashions and its design for a particular application is well within the skill of the ordinary artisan. Discharge circuit 485 may include activate components, such as transistors, and associated passive components, such as resistors, which are used to discharge excessive voltage from the regulator output prior to the beginning of the next load on time period. According to a preferred embodiment, discharge circuit 485 is an active switch circuit where the output capacitance 414 can be discharged in a finite amount of time. For example, discharge circuit 485 may include a power MOSFET with low Rdson being gated by a control signal. Using such an active device in discharge circuit 485 decreases the amount of power wasted during nonload times.

Continuing with FIG. 4, according to an embodiment, voltage regulator 410 may comprise a linear regulator. Preferably, voltage regulator 410 is an on-line linear regulator having a first input capacitor 404, a second output capacitor 414, and an error amplifier or differential amplifier 408. Preferably, the first input capacitor 404 has a value greater than the second output capacitor 414. According to an embodiment, voltage regulator 410 further comprises an output resistance. The output resistance may include a first resistance 412 and a second resistance 413 forming a sampling circuit to send a sample of the output voltage back to the input of the error amplifier 408.

According to an embodiment, amplifier 420 is an RF transistor-based circuit having an RF input 422, multiple transistors 426, and an RF output 430. There may be a detected RF output 435 for measuring the output of amplifier 420. Preferably, amplifier 420 also includes a divider 424 and a combiner 428.

In the preferred embodiment of droop compensator 450, compensation is provided to offset the droop caused by the regulator output capacitance (e.g., capacitor 414) and the inherent droop of amplifier 420 (e.g., the droop created by transistors 426). In one embodiment, the adjusted output voltage 472 may be ramped up in order to provide this compensation.

FIGS. 5–8 are graphs illustrating the performance of an exemplary droop compensation circuit under varying circumstances. FIGS. 5–8 are not necessarily drawn to scale, but are provided to illustrate the operation the exemplary droop compensator.

Figure 5:
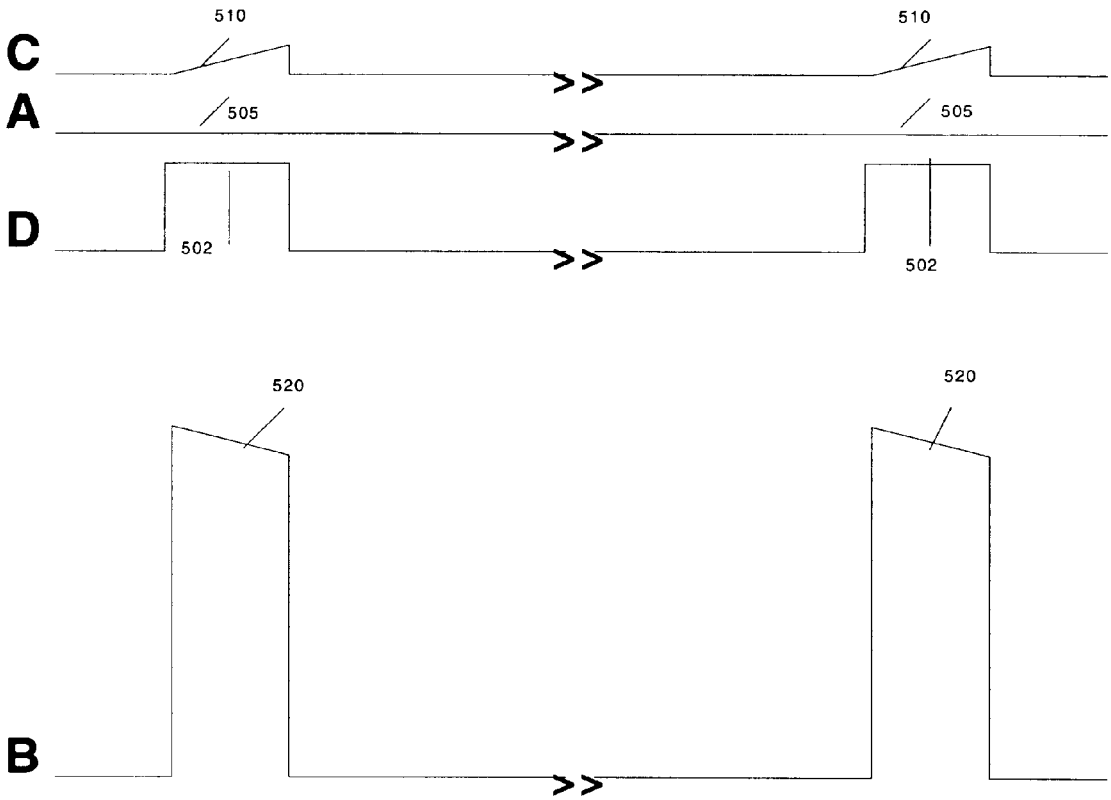
FIG. 5 is a graph illustrating the outputs of an exemplary amplifier system employing a droop compensation circuit that compensates for voltage regulator droop.

FIG. 5 is a graph illustrating the outputs of an amplifier system employing a droop compensation circuit according to a first embodiment of the invention that compensates for voltage regulator droop. In FIG. 5, graph C represents the output voltage of the exemplary droop compensator. For example, this output voltage could be the adjusted voltage 472 of FIG. 4. In FIG. 5, graph D represents the transmit gate (waveform). For example, graph D could represent the activation/deactivation of the transmit cycle in a pulsed radar system. Preferably, the transmit gate waveform is a rectified square wave, although other waveforms could be employed. Preferably graph D could be the transmit gate 464 input to offset circuit 470 in FIG. 4. In FIG. 5, graph A represents the regulator output voltage after droop compensation. For example, graph A could be the regulator output voltage 418 of FIG. 4. Finally, graph B of FIG. 5 represents the output of a transistor-based circuit supplied with the regulator output voltage. For example, graph B could be RF output 430 or detected RF output 435 of FIG. 4.

According to FIG. 5, the transmit gate is activated (on) during time periods 502. During time periods 502, the droop compensation circuit ramps up or otherwise increases its output voltage 510 so as to provide an adjusted voltage (e.g., $V_{REFERENCE}'$). This adjusted voltage compensates for regulator droop so as to render a flat regulator output voltage 505. Otherwise, during time periods 502 the regulator output voltage 505 would be decreasing (exhibiting droop). As can be seen from graph B, the output of the transistor-based circuit still exhibits some droop 520 during time periods 502. This is attributable to internal transistor droop. For example, this droop may be the droop caused by the normal droop of microwave solid state transistors.

Figure 6:
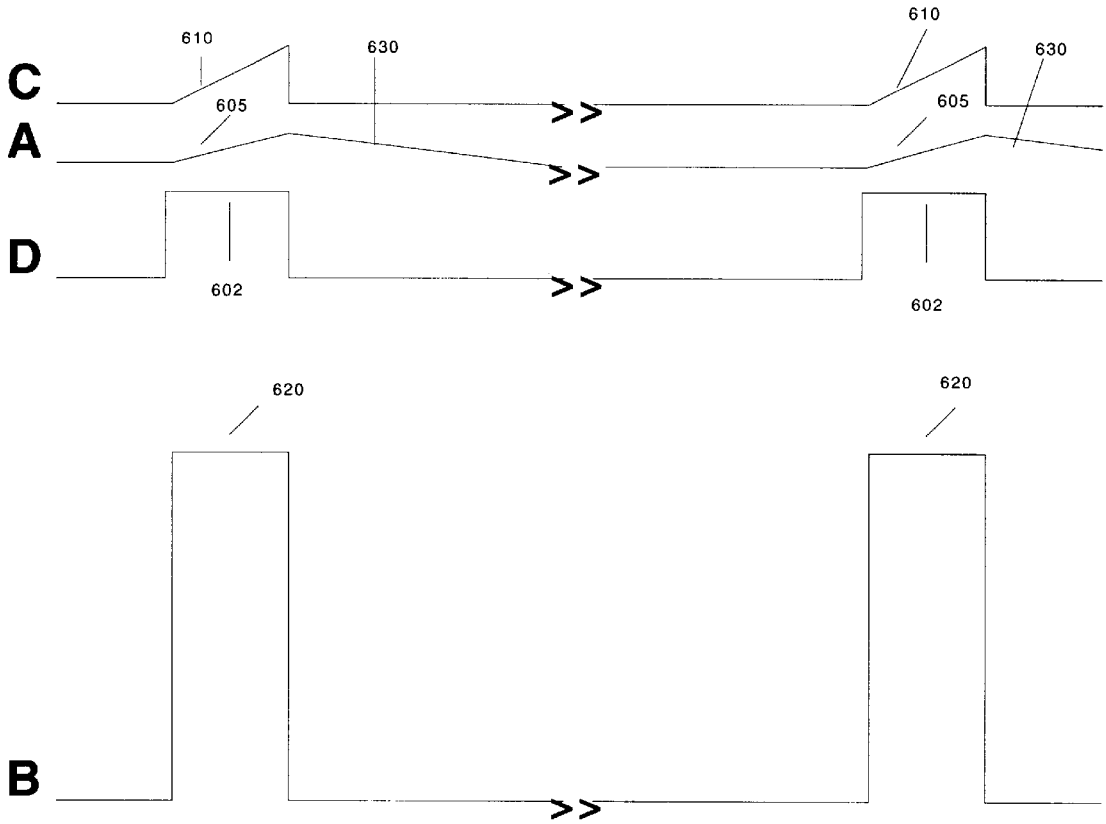
FIG. 6 is a graph illustrating the outputs of an exemplary amplifier system employing a droop compensation circuit that compensates for both voltage regulator droop and transistor droop.

FIG. 6 is a graph illustrating the outputs of an exemplary amplifier system employing a droop compensation circuit according to a second embodiment of the invention that compensates for both voltage regulator droop and transistor droop. Graphs A–D of FIG. 6 are similar to graphs A–D of FIG. 5.

In FIG. 6, during time periods 602, the droop compensation circuit ramps up or otherwise increases its output voltage 610 so as to provide an enhanced (or overcompensated) adjusted voltage. This enhanced adjusted voltage compensates for regulator droop and transistor droop so as to render a flat output 620 of the transistor-based circuit. Not only is the output flat, but the average power over the cycle is greater than that provided in the first embodiment of FIG. 5. In short, the regulator output voltage 605 during time periods 602 has been enhanced beyond nominal in order to compensate for the transistor droop in the next stage. Otherwise, during periods 602 the output 620 of the transistor-based circuit would be exhibiting droop.

The second embodiment of the invention reflected by FIG. 6 also exhibits a slow recovery time for the regulator output voltage 630 to return to nominal after the end of the transmit gate. Full recovery will be dependant on the timing of transmit gate waveform D and the RC time constant of the applied load (e.g., the transistor-based circuit).

Figure 7:
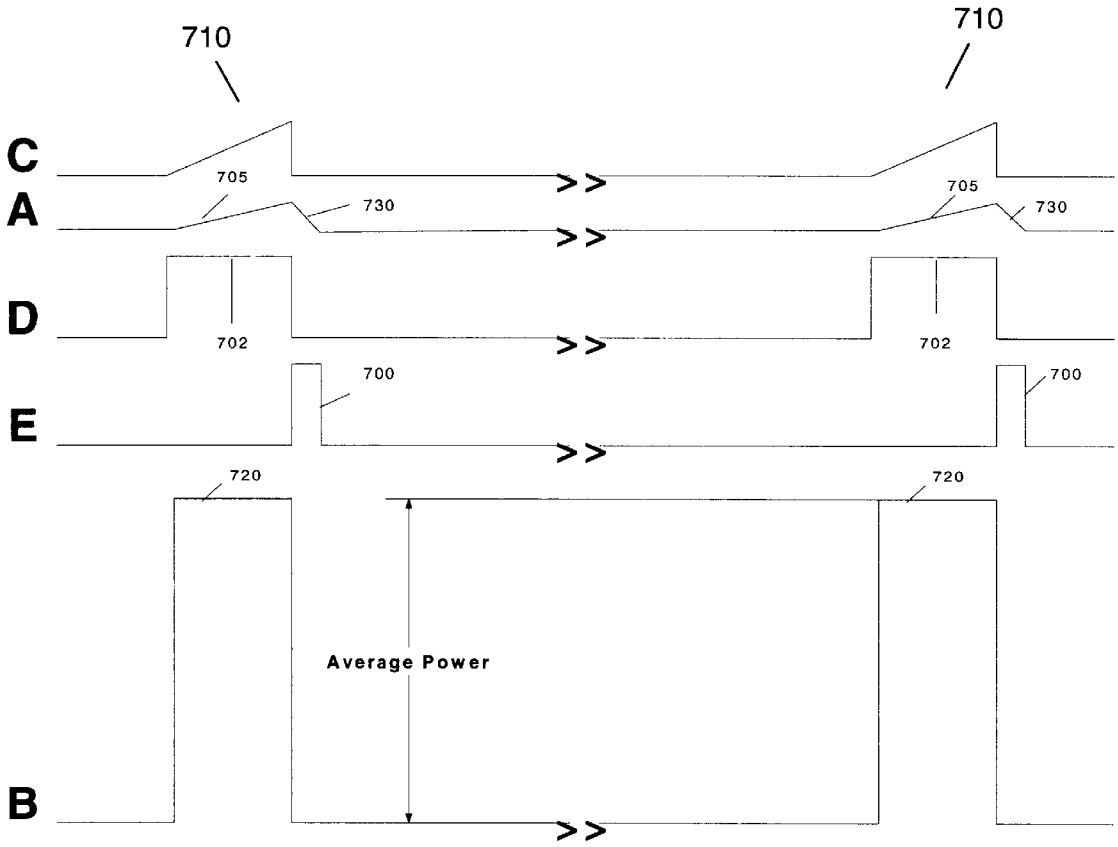
FIG. 7 is a graph illustrating the outputs of an exemplary amplifier system employing a droop compensation circuit that compensates for both voltage regulator droop and transistor droop, and further employing an energy discharge circuit.

FIG. 7 is a graph illustrating the outputs of an exemplary amplifier system according to a third embodiment of the invention employing a droop compensation circuit that further employs an energy discharge circuit that improves the recovery time of the exemplary voltage regulator. In FIG. 7, graph E represents a discharge circuit enable signal that activates or enables the discharge circuit at select times, such as at the end of a transmit cycle 702. For example, the discharge circuit enable signal could be the discharge trigger 466 input from control circuit 460 of FIG. 4.

FIG. 7 (like FIG. 6) shows that the regulator output voltage 705 is overcompensated by the output voltage 710 of the droop compensation circuit. This causes a flat output 720 of the transistor-based circuit during time periods 702. Additionally, in FIG. 7 the discharge circuit enable signal of graph E enables the discharge circuit during time periods 700, which results in a faster recovery time for the regulator output voltage 730 of graph A to return to nominal. The use of a discharge or so-called "active bleeder" circuit not only speeds recovery, but it permits a larger variety of duty cycles.

Figure 8:
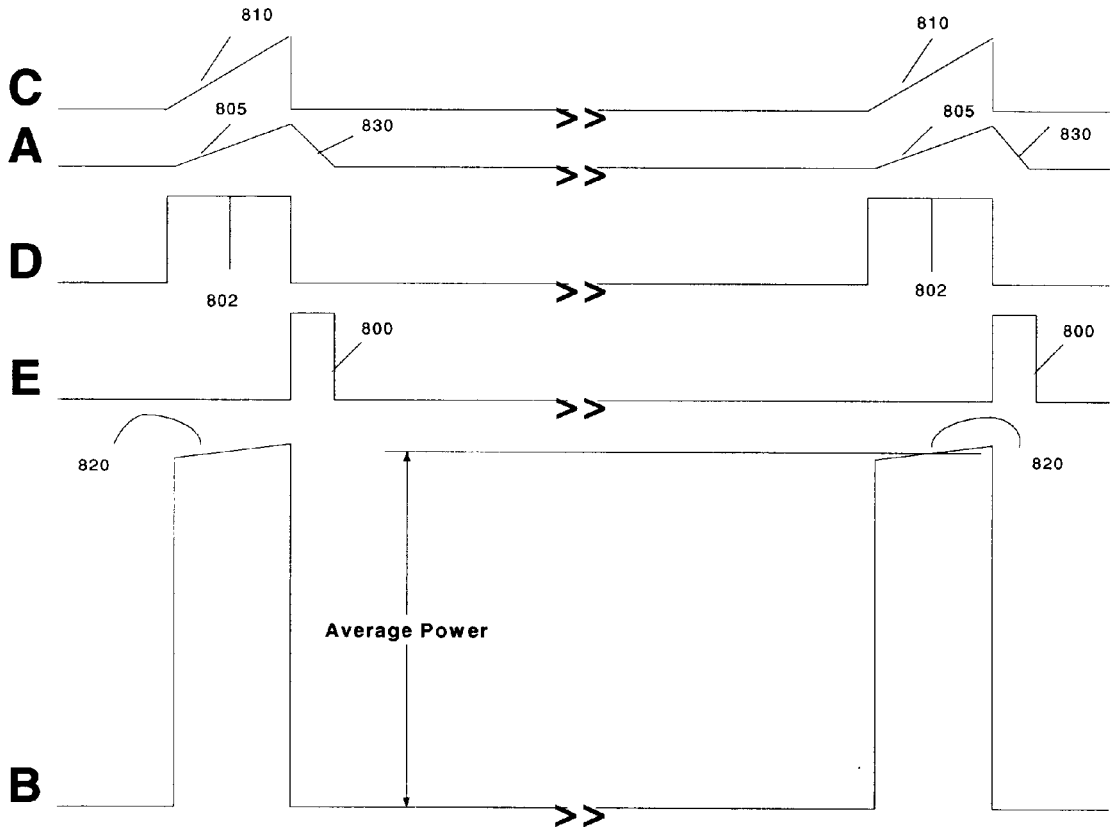
FIG. 8 is a graph illustrating the outputs of an exemplary amplifier system employing a droop compensation circuit that overcompensates for droop(s).

FIG. 8 is a graph illustrating the outputs of an exemplary amplifier system employing a droop compensation circuit according to a fourth embodiment of the invention that overcompensates for droop(s) so that there is an increasing output response. In FIG. 8, the output voltage 810 of the droop compensation circuit more than compensates for the system-wide droop, e.g., regulator droop and transistor droop. Accordingly, the output 820 of the transistor-based circuit exhibits a positive droop. The average power is increased in comparison to the third embodiment of FIG. 7. FIG. 8 also depicts the accelerated recovery time of the regulator output voltage 830 of graph A that is caused by the discharge circuit enable signal of graph E during times 800. The purpose of FIG. 8 is to illustrate that the voltage output 810 of the droop compensation circuit could be nearly any type of waveform that could be programmed in order to render a desired output response.

Figure 9:
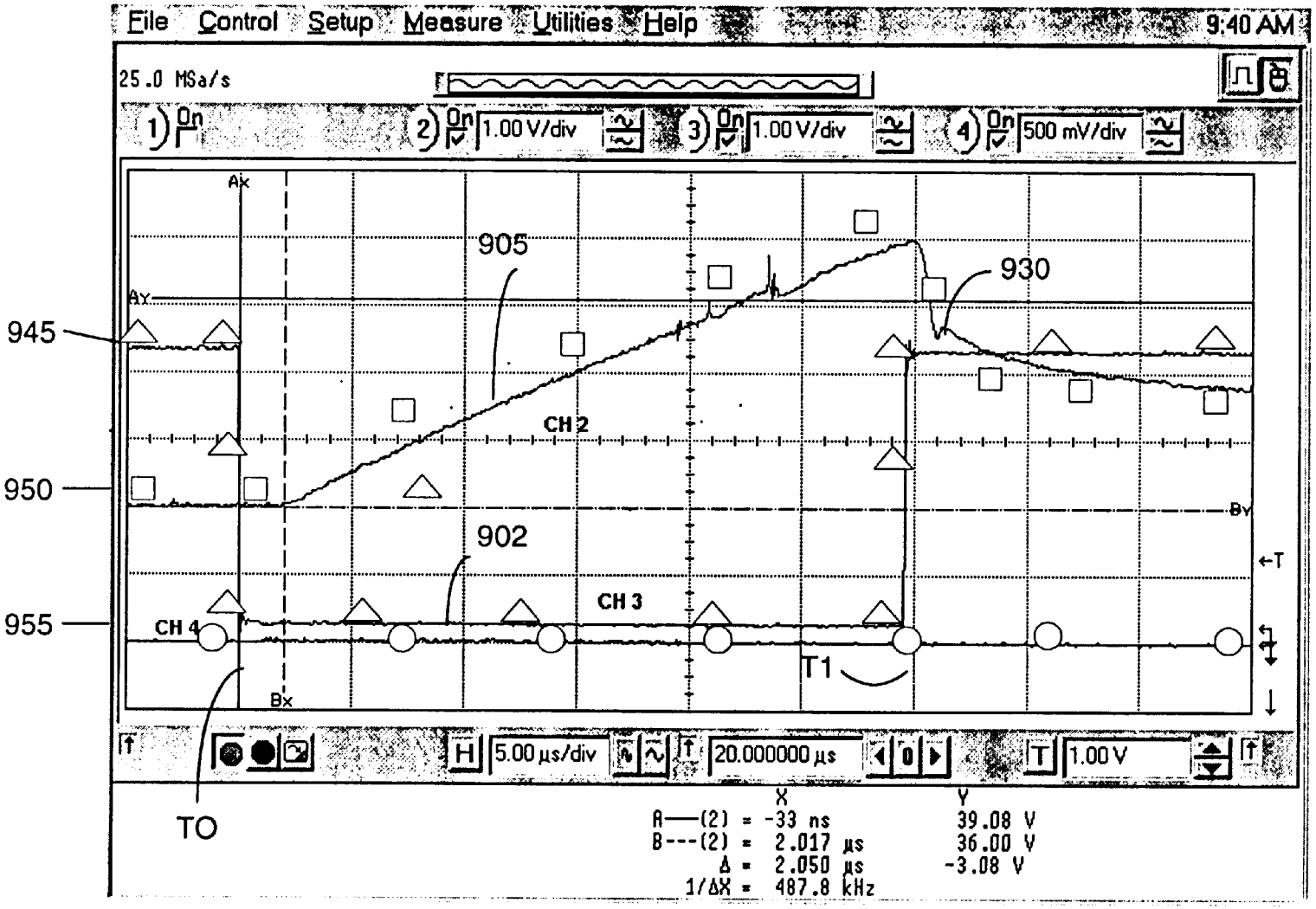
FIG. 9 is a graph illustrating the outputs of an exemplary test prototype according to an embodiment of the invention for providing a droop-compensating regulator that has not been loaded.
Figure 10:
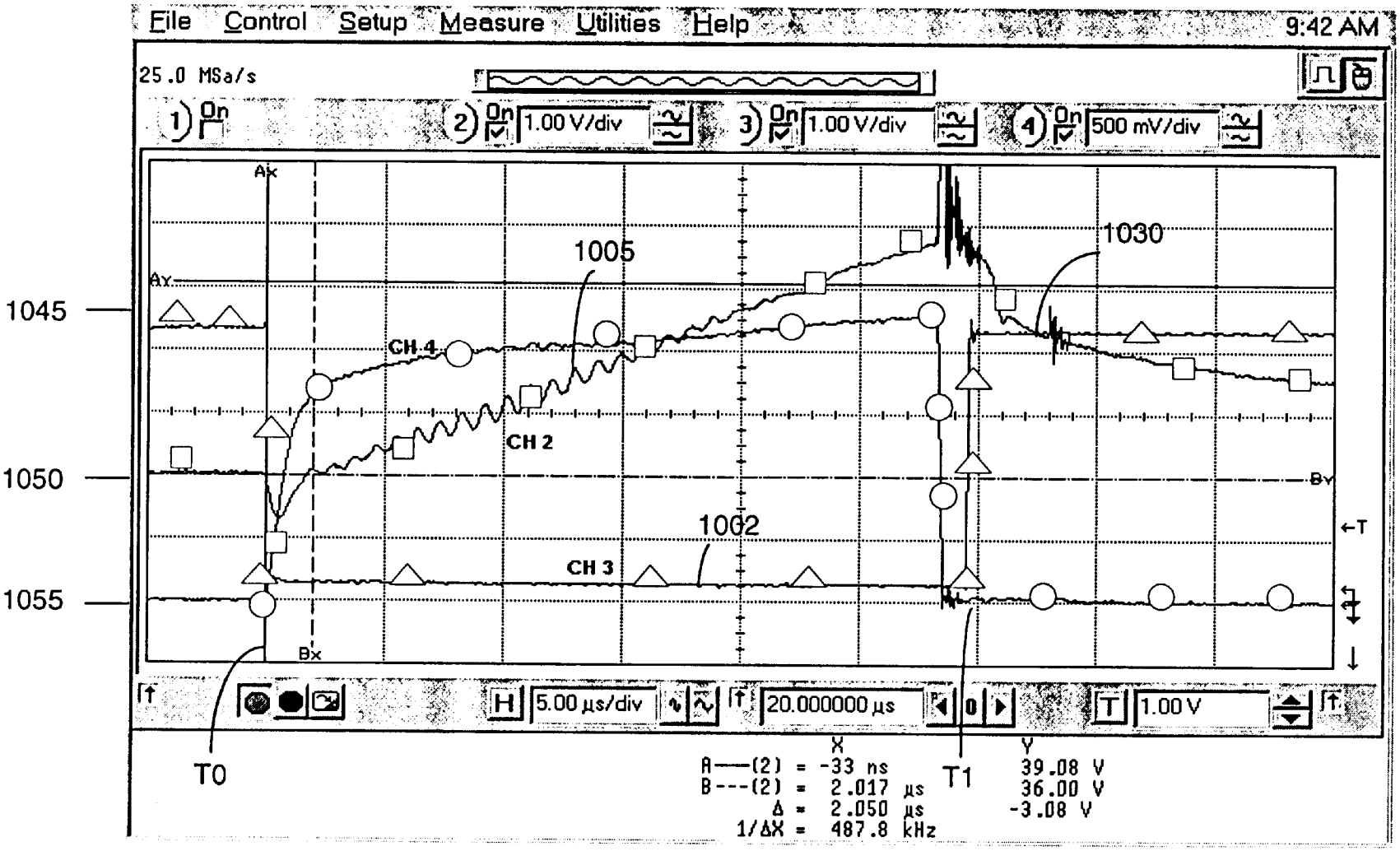
FIG. 10 is a graph illustrating the outputs of a test prototype according to an embodiment of the invention for providing a droop-compensating regulator that has been loaded with a pulsed resistive loading.
Figure 11:
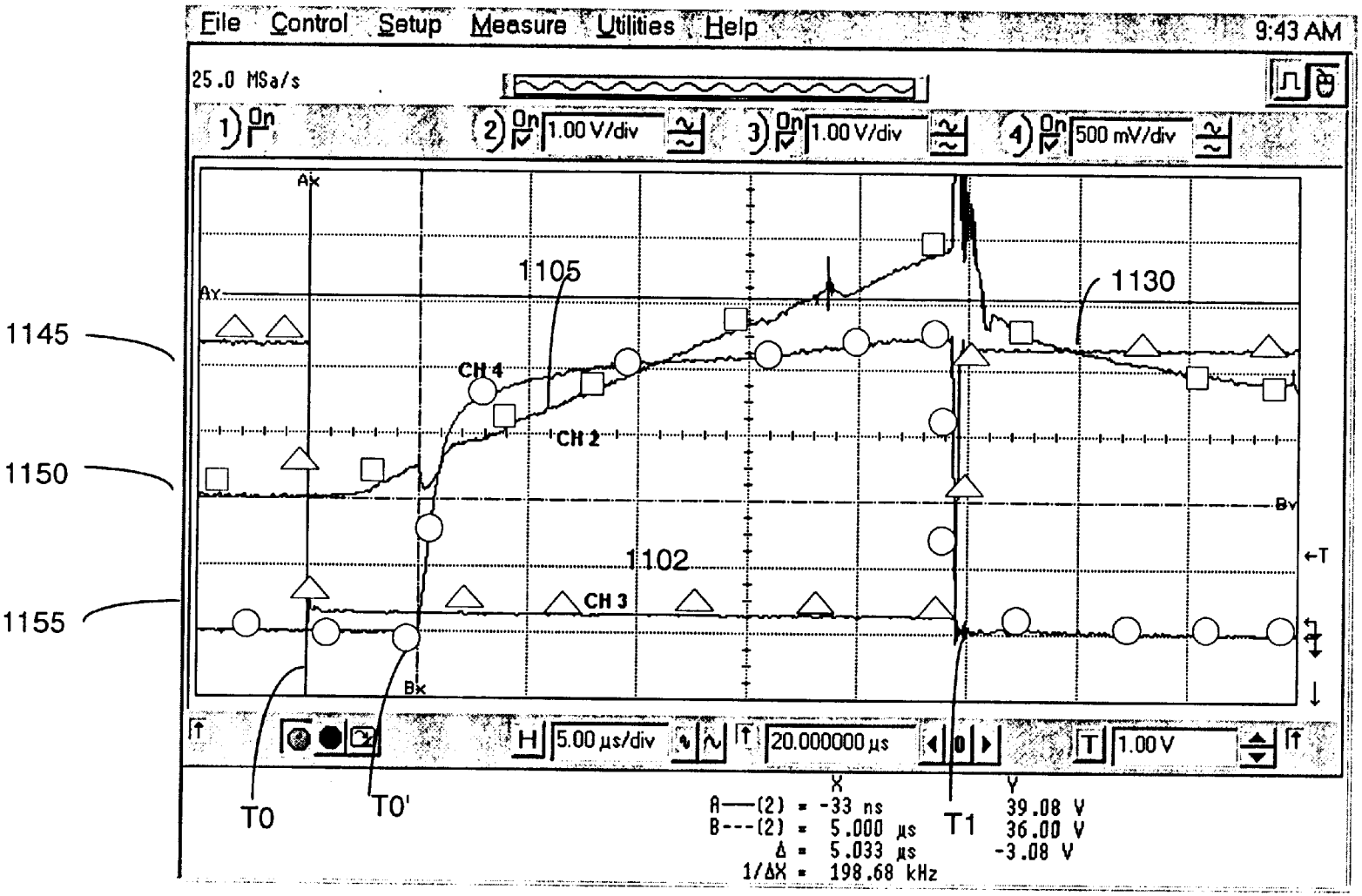
FIG. 11 is a graph illustrating the outputs of a test prototype of a droop compensating regulator according to an embodiment of the invention whereby the application of the pulsed resistive loading is delayed for a period of time after the gate pulse starts.

FIGS. 9 through 11 are captured waveforms of a breadboard regulator unit illustrating the regulator output voltage (e.g., element 418 of FIG. 4), the input trigger (e.g., element 452 of FIG. 4), and the regulated load current (e.g., current into amplifier 420 of FIG. 4). The regulator output was connected to a pulsed resistive load representing the loading of an RF transistor. Referring to FIG. 4, the exemplary droop compensation circuit was modeled after droop compensator 450. The exemplary linear voltage regulator was modeled after voltage regulator 410 of FIG. 4. In particular, the linear voltage regulator included an SG1532 voltage regulator, IRF4905 power MOSFETs for pass transistors, LS123 components for one-shot timing circuits, a 2N2222 transistor for the ramp discharge circuit, and various resistors and capacitors for scaling the output voltage. The pulsed resistive load was comprised of an N-channel power MOSFET in series with a low value resistance that was representative of the equivalent load resistance of an RF amplifier. The MOSFET was gated on by a high current pulse generator.

Referring now to the results of the test of FIG. 9, graph 945 (CH 3) is the trigger input waveform, which is in the on state during negative excursion 902. Graph 955 is the load current, which, in this case, is fixed at 0 A because no load has been applied. Graph 950 is the regulator output voltage. (FIG. 9 can be considered roughly analogous to FIG. 6.) As can be seen from FIG. 9, when the trigger input gate enters the on state, the regulator output voltage 905 is ramping up or increasing due to the effect of the droop compensation circuit. After the end of the transmit gate on state, the regulator output voltage 930 falls off during its recovery stage, although the value remains above nominal for a period of time after time T1.

FIG. 10 is similar to FIG. 9, except that the pulsed resistive load has been applied at time T0 (start of the trigger input on state) in order to simulate the transistor loading. Accordingly, the load current of graph 1055 is non-zero (peaking at about 23 Amps) over time 1002 during which graph 1045 reflects that the trigger input waveform is in the on state. Graph 1050 reflects that the regulator output voltage 1005 is ramping up or increasing due to the effect of the droop compensation circuit, although there is some oscillation (minor instability) due to the RC loading of the simulated transistor. The gate pulse period ends at time T1 and the regulator output voltage 1030 slowly recovers to nominal. The load current returns to zero.

FIG. 11 is a graph illustrating a variation whereby the pulsed resistive loading representing an RF transistor is not imposed until the passage of a time period after the trigger input waveform is in the on state. In FIG. 11, graph 1145 shows that the trigger input waveform begins the on state at time T0 for a period of time 1102 until time T1. However, the load is not applied until time TO', as reflected by graph 1155 of the load current, which does not begin to rise until just about time TO'. Graph 1050 shows that the voltage output 1105 increases during time 1102. Additionally, it can be seen that the oscillations (minor instability) exhibited in output voltage 1005 of FIG. 10 are nearly eliminated. It is believed that the delay in applying the load (TO'-TO) allows the voltage regulator to stabilize before the regulator output voltage is supplied to the pulsed resistive load (e.g., the transistor-based circuit). It can also be seen that the recovery time for the regulator output voltage 1130 seems to have improved relative to that of FIG. 10.

Those of skill in the art will recognize that the duration of the delay in applying the load can be varied, depending on the overall length of the gate pulse, the particular configuration of the circuitry, and so forth. In a preferred embodiment, the delay is about 5–25% of the length of the transmit pulse. For a 30 microsecond transmit pulse, the delay may be about 5 microseconds.

The droop compensation circuit used for FIGS. 9–11 did not include a discharge circuit (e.g., see discharge circuit 485 of FIG. 4). It can be expected that the recovery time of the regulator output voltage would improve with the addition of a discharge circuit.

Figure 12:
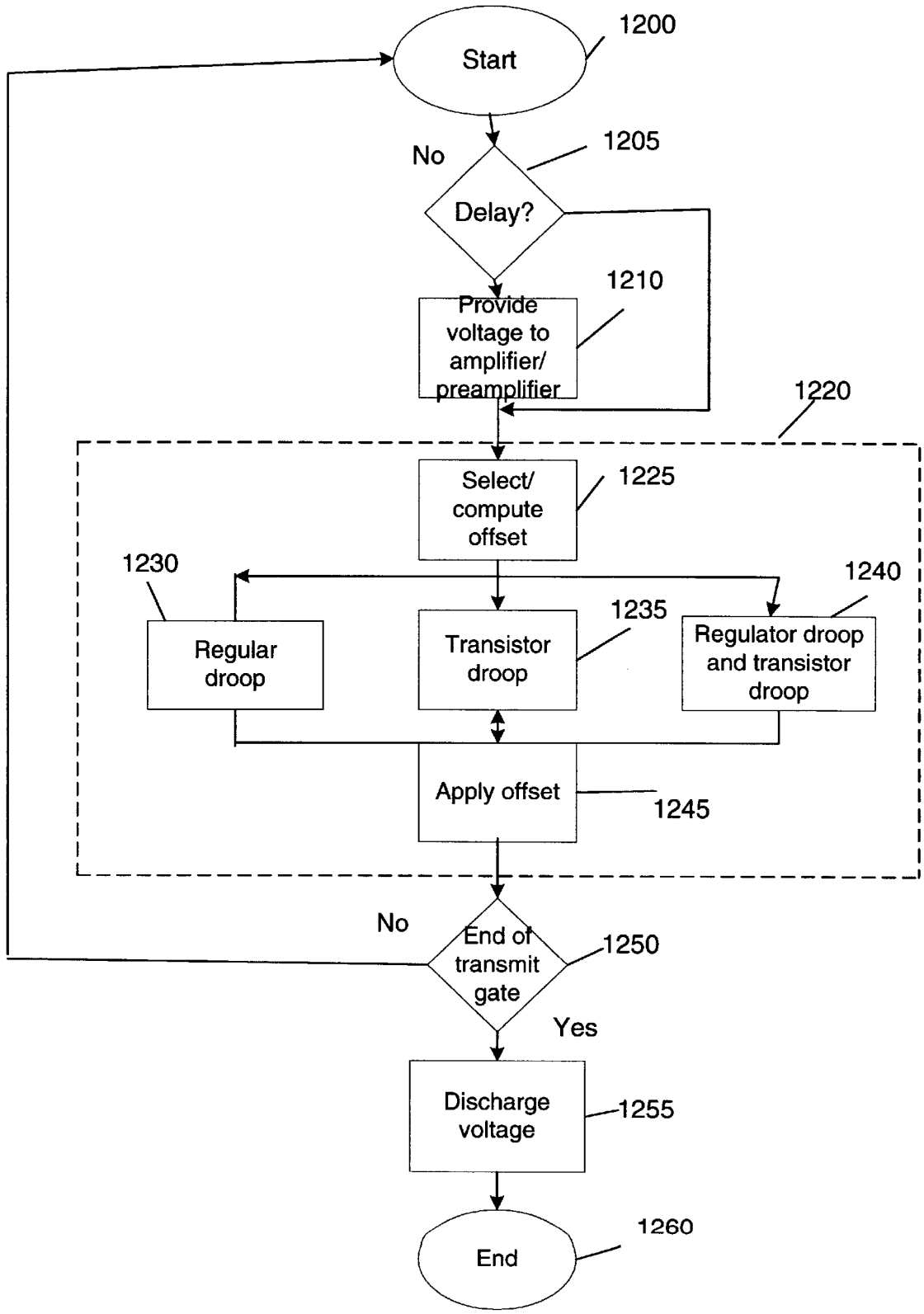
FIG. 12 is a flow diagram according to an embodiment of the invention for compensating for droop in a preamplifier circuit or amplifier circuit.

FIG. 12 is a flow diagram according to an embodiment of the invention for compensating for droop in a preamplifier circuit or amplifier circuit.

The method starts at step 1200. At step 1205, a delay (in applying a load) may be applied. If "no," the method proceeds to step 1210 where the (regulator output) voltage is provided to a preamplifier/amplifier. If "yes," step 1210 is skipped. At step 1220, compensation is provided for a variable output. This variable output may be associated with a voltage droop of a voltage regulator, a transistor droop, or any other device, component, or system exhibiting an undesirable time-variable response.

According to an embodiment, step 1220 may include the step 1225 of selecting or computing an offset. According to one or more of steps 1230–1240, the offset may be intended to compensate for one or more of a regulator droop 1230, a transistor droop 1235, and a regulator droop and a transistor droop 1240. At step 1245, the offset is applied. For example, referring to FIG. 4, the offset may be applied to a nominal reference voltage in order to supply an adjusted reference voltage (e.g., $V_{REFERENCE}'$).

It will be understood by those of skill in the art that step 1220 for compensating for a variable voltage droop could be implemented as a relatively complex prediction algorithm, a feedback-based prediction algorithm, a set of stored values reflecting expected droops, or as a simple linear ramp algorithm. Other variations of the aforementioned could be added or substituted without departing from the true spirit and scope of the present invention.

At step 1250, the end of a transmit cycle (gate pulse) may have arrived. If "no," the method returns to step 1205. If "yes," the method proceeds to step 1255, where the regulator output voltage may be discharged. The method ends at step 1260.

Having described circuitry and methods for voltage droop compensation, it is apparent that a number of beneficial applications and advantages may flow therefrom, including, but not limited to: compensating for the droop of an RF transistor and compensating for the droop of a linear regulator; compensating for the droop of the next stage in a cascaded RF design; improving overall system performance by increasing the average power of each pulse; allowing the use of low cost RF transistors; providing high fidelity inputs to successive stages; providing feed forward input to a linear regulator; providing larger effective bandwidth due to a lower required output capacitance; allowing the use of smaller energy recovery circuits; providing limited energy availability in the event of a continuous wave (CW) fault; reducing criticality of the equivalent series resistance (ESR) of capacitors due to ramp compensation; allowing a reduction in output capacitor size and an increase of input capacitor size in order to provide a local source of high energy; allowing smaller size wire to be used for bus interconnects; reducing input bus electromagnetic interference (EMI) because high inductive filtering can be applied without compromising transient response; and allowing a reduction of front-end power supply bandwidth characteristics, thereby also possibly reducing cost of the input power supplies. Other beneficial applications and advantages may exist.

Other embodiments and uses of this invention will be apparent to those having ordinary skill in the art upon consideration of the specification and practice of the invention disclosed herein. The specification and examples given should be considered exemplary only, and it is contemplated that the appended claims will cover any other such embodiments or modifications as fall within the true scope of the invention.

What is claimed is:

1. A voltage regulator with a reference voltage for regulating voltage provided to load, a preamplifier circuit or amplifier circuit, comprising:

means for compensating for a droop that occurs over time; and means for regulating a voltage output supplied to the load, the preamplifier circuit or the amplifier circuit;

wherein the voltage regulator reference voltage is adjusted by adding an offset voltage.

2. The voltage regulator of claim 1, wherein the means for compensating comprises a droop compensation circuit.

3. The voltage regulator of claim 2, wherein the means for compensating comprises a control circuit, an offset circuit, and a discharge circuit.

4. A voltage regulator for regulating voltage provided to load, a preamplifier circuit or amplifier circuit, comprising:

means for compensating for a droop that occurs over time; and means for regulating a voltage output supplied to the load, the preamplifier circuit or the amplifier circuit;

wherein the means for compensating comprises a droop compensation circuit that comprise a control circuit, an offset circuit, and a discharge circuit;

wherein the control circuit comprises a line receiver for receiving a trigger input and at least one timing generator, wherein the at least one timing generator comprises at least one of a one shot device and an analog-to-digital converter.

5. A voltage regulator for regulating voltage provided to load, a preamplifier circuit or amplifier circuit, comprising:

means for compensating for a droop that occurs over time; and means for regulating a voltage output supplied to the load, the preamplifier circuit or the amplifier circuit;

wherein the means for compensating comprises a droop compensation circuit that comprise a control circuit, an offset circuit, and a discharge circuit;

wherein the offset circuit comprise s a ramp generator.

6. A voltage regulator for regulating voltage provided to load, a preamplifier circuit or amplifier circuit, comprising:

means for compensating for a droop that occurs over time; and means for regulating a voltage output supplied to the load, the preamplifier circuit or the amplifier circuit;

wherein the means for compensating comprises a droop compensation circuit that comprise a control circuit, an offset circuit, and a discharge circuit;

wherein the offset circuit comprises a ramp generator;

wherein the offset circuit further comprises a ramp discharge circuit for discharging the ramp generator.

7. The voltage regulator of claim 3, wherein the discharge circuit comprises a transistor switch.

8. The voltage regulator of claim 2, wherein the droop compensation circuit compensates for a regulator droop.

9. The voltage regulator of claim 2, wherein the droop compensation circuit compensates for a load transistor droop.

10. The voltage regulator of claim 2, wherein the droop compensation circuit compensates for at least one of a group consisting of a regular droop and a load transistor droop.

11. A voltage regulator of claim 2, wherein the droop compensation circuit causes the load, the preamplifier circuit, or the amplifier circuit to have a substantially flat response over time.

12. The voltage regulator of claim 2, wherein the droop compensation circuit causes the load, the preamplifier circuit, or the amplifier circuit to have a non-flat response over the time, and further wherein the non-flat response is a desired response.

13. A circuit for regulating voltage provided to a preamplifier circuit or an amplifier circuit, comprising:

a droop compensation circuit for compensating for a droop that occurs over time;

the droop compensation circuit adjusting a voltage regulator reference voltage; and a voltage regulator supplying a voltage output to the preamplifier circuit or the amplifier circuit, wherein at least one of (a) the voltage regulator and (b) the preamplifier circuit or amplifier circuit, contributes to the droop.

14. The circuit of claim 13, wherein both of (a) the voltage regulator and (b) the preamplifier circuit or amplifier circuit, contribute to the droop.

15. The circuit of claim 13, wherein the preamplifier circuit or the amplifier circuit is a transistor-based circuit.

16. The circuit of claim 15, wherein the transistor-based circuit comprises an RF input, an RF output, and at least one RF transistor.

17. The circuit of claim 16, wherein the RF output exhibits a substantially flat response over time, the period of time corresponding to a gate pulse.

18. The circuit of claim 13, wherein the voltage regulator is an on-line linear voltage regulator.

19. The circuit of claim 18, wherein the voltage regulator is used to regulate the voltage supplied to a preamplifier circuit or an amplifier circuit used in a solid-state pulsed radar system.

20. A circuit for regulating voltage provided to a preamplifier circuit or an amplifier circuit, comprising:

a droop compensation circuit for compensating for a droop that occurs over time; and a voltage regulator supplying a voltage output to the preamplifier circuit or the amplifier circuit, wherein at least one of (a) the voltage regulator and (b) the preamplifier circuit or amplifier circuit, contributes to the droop;

wherein the voltage regulator is an on-line linear voltage regulator; and wherein the voltage regulator comprises a first input capacitor and a second output capacitor, the first input capacitor having a larger capacitance than the second output capacitor; an error amplifier or a differential amplifier; and an output resistance.

21. The circuit of claim 20, wherein the output resistance comprises a first resistance, the first resistance defining a first voltage drop between a negative terminal of the error amplifier or the differential amplifier and ground, and a second resistance, the second resistance defining a second voltage drop between the voltage output of the voltage regulator and the first voltage drop.

22. A circuit, comprising:

a droop compensation circuit, comprising a control circuit for controlling a variable voltage to be inputted into a voltage regulator, an offset circuit for generating an offset voltage to be combined with a reference voltage, and a regulator discharge circuit for discharging the output of the voltage regulator, wherein the droop compensation circuit is adapted to adjust a voltage regulator reference voltage;

a voltage regulator circuit coupled to said droop compensation circuit; and a load, a preamplifier circuit, or an amplifier circuit receiving a voltage output from said voltage regulator circuit.

23. The circuit of claim 22, wherein the offset circuit comprises a ramp generator and a ramp discharge circuit.

24. The circuit of claim 22, wherein the regulator discharge circuit comprises a transistor switch.

25. The circuit of claim 22, wherein the droop compensation circuit compensates for at least one of a regulator droop and a load transistor droop.

26. The circuit of claim 22, wherein the droop compensation circuit compensates for a load transistor droop.

27. The circuit of claim 22, wherein the droop compensation circuit compensates for a regulator droop and a load transistor droop.

28. The circuit of claim 22, wherein the load, the preamplifier circuit, or the amplifier circuit exhibits a substantially flat output response.

29. The circuit of claim 22, wherein the load, the preamplifier circuit, or the amplifier circuit exhibits a non-flat output response, and further wherein the non-flat response is a desired response.

30. The circuit of claim 22, wherein the circuit is an on-line linear voltage regulator.

31. The circuit of claim 30, wherein the circuit is used in a solid state pulsed radar system.

32. The circuit of claim 30, wherein the voltage regulator circuit comprises a first input capacitor and a second output capacitor, the first input capacitor having a larger capacitance than the second output capacitor; an error amplifier or a differential amplifier; and an output resistance.

33. The circuit of claim 22, wherein the load, the preamplifier circuit, or the amplifier circuit, is a transistor-based circuit.

34. The circuit of claim 33, wherein the transistor-based circuit comprises an RF input, an RF output, and at least one transistor.

35. The circuit of claim 34, wherein the RF output exhibits a substantially flat response over a period of time, the period of time corresponding to a gate pulse.

36. A circuit, comprising:

a droop compensation circuit;

a voltage regulator circuit coupled to said droop compensation circuit and a load, a preamplifier circuit, or an amplifier circuit receiving a voltage output from said voltage regulator circuit;

wherein the droop compensation circuit comprise a control circuit for controlling a variable voltage to be inputted into a voltage regulator, an offset circuit for generating an offset voltage to be combined with a reference voltage, and a regulator discharge circuit for discharging the output of the voltage regulator;

wherein the control circuit comprises a line receiver for receiving a trigger input and at least one timing generator, wherein the at least one timing generator comprises one of a one shot device and analog-to-digital converter.

37. A circuit, comprising:

a droop compensation circuit for compensating for a voltage droop that occurs over time;

a voltage regulator circuit for regulating voltage, said voltage regulator circuit being coupled to said droop compensation circuit; and a load, a preamplifier circuit, or an amplifier circuit for receiving a voltage output from the voltage regulator circuit;

wherein the circuit is an on-line linear voltage regulator; and wherein the voltage regulator circuit comprises a first input capacitor and a second output capacitor, the first input capacitor having a larger capacitance than the second output capacitor; an error amplifier or a differential amplifier; and an output resistance; and wherein the output resistance comprises a first resistance, the first resistance defining a first voltage drop between a negative terminal of the error amplifier or the differential amplifier and ground, and a second resistance, the second resistance defining a second voltage drop between a voltage output of the voltage regulator and the first voltage drop.

38. A circuit, comprising:

a droop compensation circuit, wherein the droop compensation circuit comprise control means for controlling a variable voltage to be inputted into a voltage regulator, offset means for generating an offset voltage to be combined with a reference voltage, and discharge means for discharging the output of the voltage regulator, wherein the droop compensation circuit is adapted to adjust a voltage regulator reference voltage;

a voltage regulator circuit coupled to said droop compensation circuit; wherein the voltage regulator circuit is an on-line linear regulator circuit used to regulate a pulsed radar system, and comprising a first input capacitor and a second output capacitor, the first input capacitor having a larger capacitance than the second output capacitor; an error amplifier or a differential amplifier; and an output resistance; and a preamplifier circuit or an amplifier circuit receiving a voltage output from said voltage regulator circuit, wherein the preamplifier circuit or the amplifier circuit comprises a transistor-based circuit having an RF input, an RF output and multiple transistors.

39. A droop compensation circuit, comprising:

means for controlling a variable voltage to be input as an adjusted reference voltage;

means for generating the variable voltage;

wherein the variable voltage is capable of being input to a voltage regulator to offset a variable output.

40. The droop compensation circuit of claim 39, wherein the variable output results from a regulator droop.

41. The droop compensation circuit of claim 39, wherein the variable output results from a load transistor droop.

42. The droop compensation circuit of claim 39, wherein the variable output results from a regulator droop and load transistor droop.

43. The droop compensation circuit of claim 39, wherein the variable output is offset to achieve a desired output response for a period of time.

44. The droop compensation circuit of claim 43, wherein the desired output response is substantially flat over the period of time, the period of time corresponding to a gate pulse.

45. The droop compensation circuit of claim 43, wherein the desired output response is non-flat over the period of time.

46. The droop compensation circuit of claim 43, wherein the period of time corresponds to the duration of a radar pulse.

47. A droop compensation circuit, comprising:

a control circuit for controlling a variable voltage to be input as an adjusted reference voltage;

an offset circuit for generating the variable voltage;

wherein the variable voltage is capable of being input to a voltage regulator to offset a droop.

48. The droop compensation circuit of claim 47, wherein the control circuit includes a trigger input for activating the droop compensation circuit and a transmit gate output coupled to the offset circuit.

49. The droop compensation circuit of claim 48, wherein the trigger input activates the offset circuit prior to the application of a load to the voltage regulator.

50. The droop compensation circuit of claim 49, wherein the trigger input activates the offset circuit a predetermined amount of time prior to the application of the load.

51. The droop compensation circuit of claim 47, wherein the offset circuit includes a transmit gate input received from the control circuit and a nominal reference voltage input.

52. The droop compensation circuit of claim 51, wherein the variable voltage equals the nominal voltage plus a computed or selected offset.

53. The droop compensation circuit of claim 48, wherein the variable voltage adapted to be input to a positive terminal of an error amplifier or a differential amplifier.

54. The droop compensation circuit of claim 47, further comprising means for discharging a voltage output of the voltage regulator.

55. The droop compensation circuit of claim 54, wherein the means for discharging comprises a switching transistor.

56. The droop compensation circuit of claim 55, wherein the means for discharging is adapted to discharge excessive voltage from a voltage output of the voltage regulator.

57. The droop compensation circuit of claim 55, wherein the means for discharging includes an input from the control circuit that activates the means for discharging.

58. The droop compensation circuit of claim 55, wherein the means for discharging improves a recovery time for a voltage output of the voltage regulator to return to a nominal reference value.

59. A droop compensation circuit, comprising:

a control circuit for controlling a variable voltage to be input as an adjusted reference voltage;

an offset circuit for generating the variable voltage;

wherein the variable voltage is capable of being input to a voltage regulator to offset a droop;

wherein the control circuit comprises a line receiver for receiving a trigger input and at least one timing generator, wherein the at least one timing generator comprises at least one of a one shot device and an analog-to-digital converter.

60. A method to regulate voltage provided to a load, a preamplifier circuit, or an amplifier circuit, comprising:

providing a voltage supplied to the load, the preamplifier circuit, or the amplifier circuit;

compensating for a variable output;

wherein the step of compensating compensates for at least one of a regulator droop and a load transistor droop by adjusting a regulator reference voltage.

61. The method of claim 60, wherein the step of compensating compensates for both a regulator droop and a load transistor droop.

62. The method of claim 60, wherein the step of compensating renders a desired output response of the load, the preamplifier circuit or the amplifier circuit.

63. The method of claim 62, wherein the desired output response is substantially flat.

64. The method of claim 62, wherein the desired output response is non-flat.

65. The method of claim 60, wherein the step of compensating comprises computing or selecting an offset to a nominal reference voltage over a period of time.

66. The method of claim 60, wherein the step of compensating comprises selecting a offset based on an offset ramp having a linear slope.

67. The method of claim 65, wherein the period of time corresponds to a transmit cycle in a solid-state pulsed radar system.

68. The method of claim 60, further comprising the step of discharging the voltage.

69. The method of claim 68, wherein the step of discharging returns the voltage to a nominal reference voltage.

70. The method of claim 69, wherein the step of discharging accelerates the return of the voltage to the nominal reference voltage.

71. The method of claim 60, wherein the step of providing is delayed for a first period of time after the step of compensating.

72. The method of claim 71, wherein the delay quickens a recovery time for the voltage to return to a nominal reference voltage.

73. The method of claim 71, wherein the delay reduces instability or oscillations otherwise present in the voltage output.

* * * * *